US005592800A

United States Patent [19]

Koo et al.

[11] Patent Number: 5,592,800

[45] Date of Patent: Jan. 14, 1997

[54] TRUSS WITH ADJUSTABLE ENDS AND METAL WEB CONNECTORS

[75] Inventors: Kenneth G. Koo, Richmond Hill; Bill M. Tully, L'Acadie, both of Canada

[73] Assignee: Truswal Systems Corporation, Arlington, Tex.

[21] Appl. No.: 375,928

[22] Filed: Jan. 20, 1995

[51] Int. Cl.[6] ..... E04C 3/30

[52] U.S. Cl. ..... 52/692; 52/693; 52/729.4

[58] Field of Search ..... 52/729.4, 730.1, 52/730.3, 730.5, 730.7, 731.1, 690, 693, 694, 695, 692

[56] References Cited

U.S. PATENT DOCUMENTS

| | | | |
|---|---|---|---|
| Re. 31,807 | 1/1985 | Knowles . | |
| 3,490,188 | 1/1970 | Troutner | 52/690 X |
| 3,651,612 | 3/1972 | Schmitt | 52/690 X |
| 3,849,963 | 11/1974 | Harmon | 52/729.4 |
| 4,078,352 | 3/1978 | Knowles . | |
| 4,336,678 | 6/1982 | Peters | 52/690 X |
| 4,435,929 | 3/1984 | Bussell | 52/690 X |
| 4,501,102 | 2/1985 | Knowles | 52/690 |
| 4,637,194 | 1/1987 | Knowles | 52/729.4 X |
| 4,852,322 | 8/1989 | McDermid | 52/729.4 X |
| 4,862,662 | 9/1989 | Eberle et al. | 52/729.4 X |

FOREIGN PATENT DOCUMENTS

| | | | |
|---|---|---|---|
| 1356941 | 6/1974 | United Kingdom | 52/692 |

*Primary Examiner*—Lanna Mai
*Attorney, Agent, or Firm*—W. Kirk McCord

[57] ABSTRACT

A load bearing truss includes first and second generally parallel chord members, first and second post members coupled between the first and second chord members and a plurality of V-shaped metal webs interconnecting the first and second chord members. Respective portions of the first and second chord members extend beyond the first and second post members. A first connector member interconnects the portions of the first and second chord members extending beyond the first post member to define a first end section and a second connector member interconnects the portions of the first and second chord members extending beyond the second post member to define a second end section. The truss is lengthwise adjustable by trimming a selected one or both of the first and second end sections.

8 Claims, 2 Drawing Sheets

TRUSS WITH ADJUSTABLE ENDS AND METAL WEB CONNECTORS

FIELD OF INVENTION

This invention relates generally to floor trusses used in building construction in and particular to a floor truss having adjustable ends and metal connector webs.

BACKGROUND ART

One type of conventional floor truss which is used for supporting building floor surfaces, roof decks and the like is formed with a pair of parallel wooden chords, such as 2×4 or 2×3 wood members, arranged one above the other, and interconnected by diagonally arranged webs or struts made of wood or sheet metal. The webs are fastened at their opposite ends to the respective chords by means of nailing or by overlapping them with so-called connector plates, which are flat plates with struck-out teeth extending through holes in the web ends for being embedded within the wooden chords. Such types of trusses are normally manufactured in a factory building and transported to a construction site for installation as part of a building.

It is also known in the art of truss design and construction to use V-shaped metal webs of the type shown and described in U.S. Pat. No. 4,078,352 and U.S. Pat. No. Re. 31,807. In this type of web, the connector plates are integrally formed with the web legs, which increases the strength of the truss and reduces handling and assembly of separate components.

According to prior practice, trusses have been custom fabricated on an as ordered basis. Each truss was made to design specifications to fit the particular order with no alterations permissible at the job site. Having to custom design each truss order slows down the truss manufacturing process and the ability to respond quickly to orders from the field. Further, the inability to adjust the length of the truss on site further slows down the construction process if a customized order does not meet the on the site specifications.

There is therefore a need for standard length truss designs which can be customized on site as required.

DISCLOSURE OF THE INVENTION

In accordance with the present invention, a truss adapted to support a load is comprised of first and second generally parallel wooden chord members, first and second wooden post members coupled between the first and second chord members and a plurality of V-shaped metal webs interconnecting the first and second chord members. Each web has an apex portion and two elongated, diverging legs with enlarged end portions. Each web further includes a plurality of teeth projecting from the apex portion and from the enlarged end portions, whereby the corresponding web is connected to the first and second chord members. The webs are interposed between the first and second post members. The interconnection of the webs with the first and second chord members defines a primary section of the truss.

In accordance with one aspect of the invention, respective portions of both the first and second chord members extend beyond the first and second post members. The truss further includes first and second wood end connector members. The first end connector member interconnects the portions of the first and second chord members extending beyond the first post member to define a first end section and the second end connector member interconnects the portions of the first and second chord members extending beyond the second post member to define a second end section. The length of each end section is adjustable by trimming the first and second chord members and the corresponding end connector member, whereby the length of the truss is adjustable.

In accordance with one embodiment of the invention, each of the first and second end connector members is a relatively flat wooden sheet having opposed rectangular major surfaces and four minor edge surfaces. The portions of the first and second chord members extending beyond the first post member have respective first and second elongated grooves in facing relationship for receiving two of the four edge surfaces of the first connector sheet. Similarly, the portions of the first and second chord members extending beyond the second post member have respective third and fourth elongated grooves in facing relationship for receiving two of the four edge surfaces of the second connector sheet. The first and second connector sheets are affixed to the first and second chord members, preferably by gluing.

In accordance with another embodiment of the invention, the respective portions of the first and second chord members defining the respective end sections of the truss each have a plurality of holes which are alignable with respective holes in the corresponding end connector member. A plurality of first pins extend through aligned pairs of holes in the first chord member and each end connector member and a plurality of second pins extend through aligned pairs of holes in the second chord member and each end connector member to locate the end connector members with respect to the first and second chord members. The end connector members are affixed to the first and second chord members by suitable means, such as by gluing. A suitable fastener such as glue may also be applied to the pins to help secure the end connector members to the first and second chord members.

In accordance with the present invention, a load bearing truss assembled with V-shaped metal webs for strength and ease of assembly also includes adjustable end sections, whereby the length of the truss may be adjusted on site by trimming the length of one or both end sections. Because the truss is adjustable on site, standard truss lengths (e.g., 10, 12, 14, 16 feet) may be pre-fabricated and stored for sale by lumber yards at a later time. Numerous advantages are achieved by allowing lumber yards to pre-fabricate trusses in standard lengths during slow business periods and in larger production runs than would be allowed if each truss were custom fabricated. Faster delivery times are also achieved because an inventory of standard truss lengths would be in stock for potential customers.

BEST MODE FOR CARRYING OUT THE INVENTION

Figure 1:
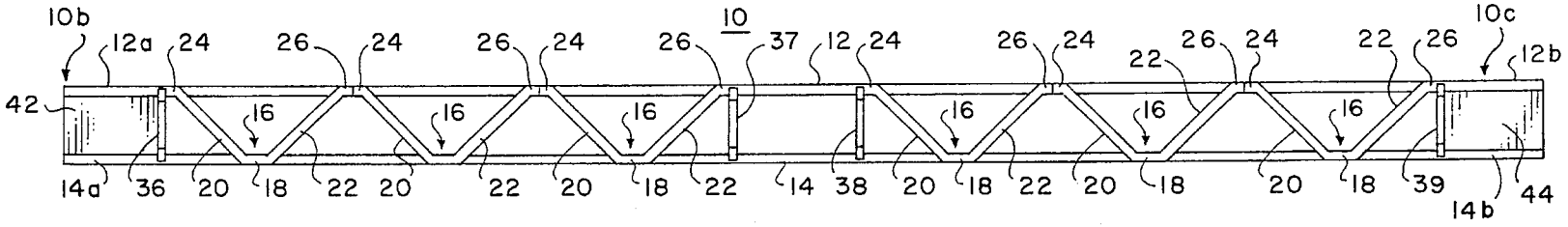
FIG. 1 is an elevation view of a floor truss with adjustable end sections, according to the present invention.
Figure 3:
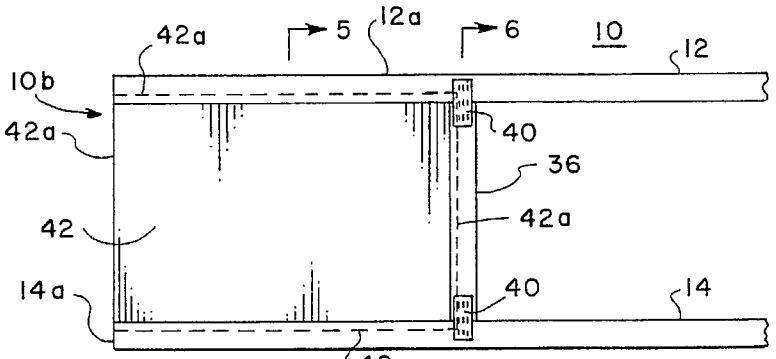
FIGS. 3 and 4 are elevation views of portions of the truss of FIG. 1, showing the left end section of the truss in greater detail.
Figure 4:
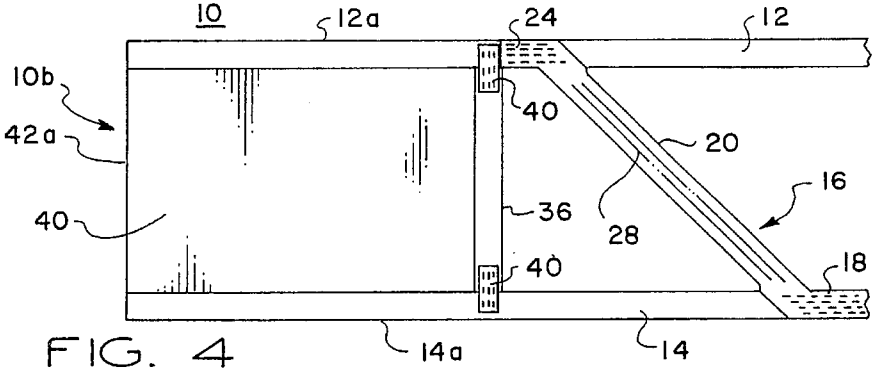
Figure 2:
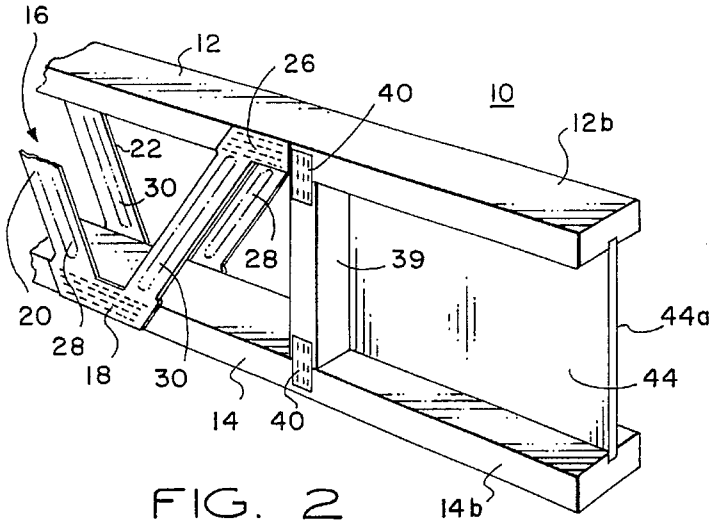
FIG. 2 is a partial perspective view of the truss of FIG. 1, showing the right end section of the truss in greater detail.
Figure 5:
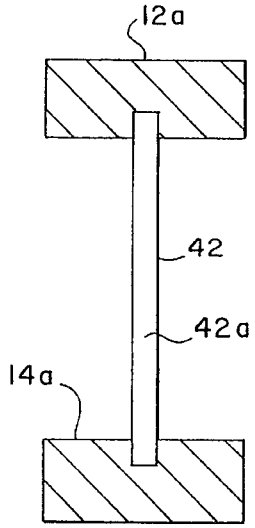
FIG. 5 is a sectional view, taken along the line 5—5 of FIG. 3.

In the description which follows, like parts are marked throughout the specification and drawings with the same respective reference numbers. The drawings are not necessarily to scale and in some instances proportions may have been exaggerated in order to more clearly depict certain features of the invention.

Referring to FIGS. 1–6, a truss 10 of the type typically used to support a floor in a building is comprised of top and bottom chords 12 and 14, respectively, and a plurality of metal webs 16 interconnecting top and bottom chords 12 and 14. Top and bottom chords 12 and 14 are preferably 2×4's or 2×3's with the respective major surfaces facing upwardly and downwardly, as can be best seen in FIG. 2. Webs 16 are preferably V-shaped metal webs of the type shown and described in U.S. Pat. No. 4,078,352 and U.S. Pat. No. Re. 31,807, the respective specifications of which are incorporated by reference herein. Specifically, each web 16 has a relatively flat apex portion 18 having a plurality of teeth (not shown) projecting therefrom which are embedded into bottom chord 14, and leg portions 20 and 22 emanating from apex portion 18 in diverging relationship to define an open web configuration. Each leg 20, 22 has an enlarged end portion 24, 26, which extends transversely with respect to a longitudinal axis of the corresponding leg portion 20, 22. Each end portion 24, 26 is relatively flat with a plurality of teeth (not shown) projecting therefrom which are embedded into top chord 12. Each leg 20, 22 includes a groove 28, 30 for structural rigidity. Further, the edges of each leg 20, 22 are bent to form continuous inner and outer flanges.

Four vertical posts 36, 37, 38 and 39 extend between top and bottom chords 12 and 14 and are connected thereto by metal connector plates 40. The intermediate vertical posts 37 and 38 define an opening 41 in truss 10 through which ductwork is allowed to pass. The outer two posts 36 and 39 define the respective boundaries of a primary section 10*a* of truss 10.

In accordance with the present invention, respective portions 12*a* and 14*a* of top and bottom chords 12 and 14 extend beyond left post 36 and respective portions 12*b* and 14*b* of top and bottom chords 12 and 14 extend beyond right post 39. A relatively flat rectangular wooden sheet 42 is attached to extension portions 12*a* and 14*a* and a relatively flat rectangular wooden sheet 44 is attached to extension portions 12*b* and 14*b*, as will be described in greater detail hereinbelow. Each sheet 42, 44 has opposed rectangular major surfaces and four minor edge surfaces. The edge surfaces of sheet 42 are indicated by reference number 42*a* and the edge surfaces of sheet 44 are indicated by reference number 44*a*.

Extension portions 12*a* and 14*a* have respective horizontal grooves extending from vertical post 36 to the respective distal ends of extension portions 12*a* and 14*a*. Vertical post 36 has a vertical groove extending substantially the entire length thereof. The horizontal grooves are adapted to receive opposed top and bottom edge surfaces 42*a* of sheet 42 and the vertical groove is adapted to receive the inner edge surface 42*a* of sheet 42, as can be best seen in FIG. 3. Similarly, extension portions 12*b* and 14*b* have respective horizontal grooves extending from vertical post 39 to the respective distal ends of extension portions 12*b* and 14*b*. Vertical post 39 has a vertical groove extending substantially the entire length thereof. Horizontal grooves in extension portions 12*b* and 14*b* are adapted to receive opposed top and bottom edge surfaces 44*a* of sheet 44 and the vertical groove in post 39 is adapted to receive the inner edge surface 44*a* of sheet 44. An adhesive material such as glue is preferably applied inside each of the grooves and to the corresponding edge surfaces 42*a*, 44*a* to affix sheet 42 to extension portions 12*a* and 14*a* and sheet 44 to extension portions 12*b* and 14*b*. Sheet 42 and extension portions 12*a* and 14*a* define a left end section 10*b* of truss 10 and sheet 44 and extension portions 12*b* and 14*b* define a right end section 10*c* of truss 10. Each end section 10*b*, 10*c* has an I-beam configuration, as can be best seen in FIG. 5.

Figure 6:
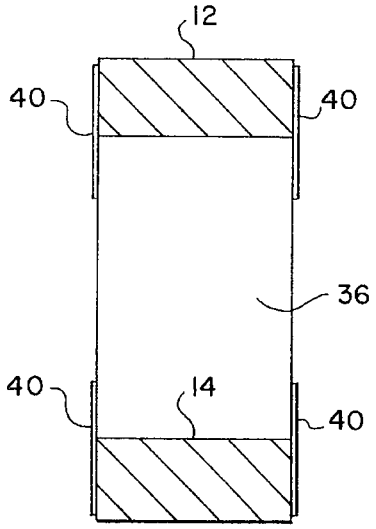
FIG. 6 is a sectional view, taken along the line 6—6 of FIG. 3.

As shown in FIG. 6, each vertical post 36, 37, 38 and 39 is attached to top and bottom chords 12 and 14 by two connector plates 40 on each side of truss 10. Each connector plate 40 has a plurality of teeth projecting therefrom which are embedded into the corresponding vertical post 36, 37, 38, 39 as well as into one of the top and bottom chords 12, 14. In FIG. 6, vertical post 36, which is also preferably a wooden 2×4 or 2×3, extends between the downwardly facing major surface of top chord 12 and an upwardly facing major surface of bottom chord 14. The two top connector plates 40 are embedded into the laterally facing minor surfaces of top chord 12 and into the laterally facing minor surfaces of post 36 to interconnect post 36 with top chord 12. The two bottom connector plates 40 are embedded into the laterally facing minor surfaces of bottom chord 14 and into the laterally facing minor surfaces of post 36 to connect post 36 with bottom chord 14. Each plate 40 is preferably a 1.5×3 inch rectangular connector plate.

The assembly of truss 10 is as follows. End sections 10*b* and 10*c* are formed first by attaching sheets 42 and 44 to the respective extension portions of the top and bottom chords 12 and 14, as described above. Sheets 42 and 44 are attached by a suitable adhesive such as glue to the top and bottom chords. The vertical posts 36 and 39 are then attached to the top and bottom chords 12 and 14 to define the boundaries between end sections 10*b* and 10*c* and primary section 10*a* of truss 10. The span of truss 10 between post 36 and 39 defines primary section 10*a*. Each post 36 and 39 is positioned approximately 12 inches inwardly from a corresponding distal end of truss 10 so that each end section 10*b*, 10*c* has a length of approximately 12 inches. The thickness of sheet 42, 44 is preferably on the order of ⅝ inch. Each section 10*b*, 10*c* can be trimmed at the job site as required. For example, if the overall length of truss 10, including end sections 10*b* and 10*c*, is 20 feet, the truss can be configured for any length between 18 and 20 feet by trimming one or both end sections 10*b*, 10*c*.

Figure 7:
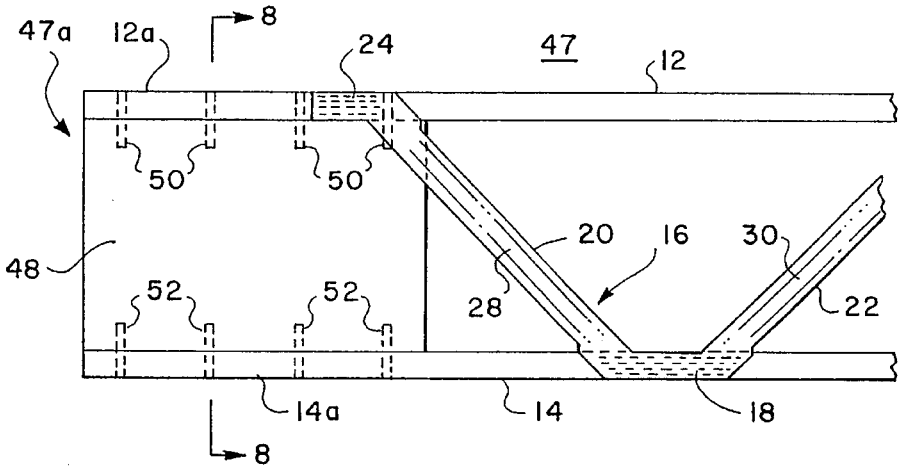
FIG. 7 is an elevation view of a portion of the truss, showing an alternate embodiment of the truss end section.
Figure 8:
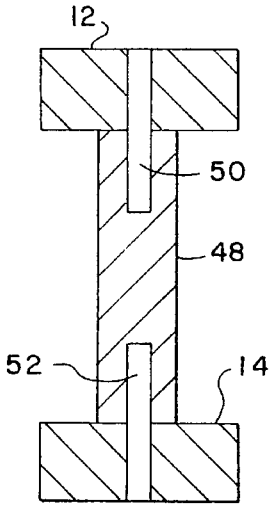
FIG. 8 is a sectional view, taken along the lines 8—8 of FIG. 7.

Referring to FIGS. 7 and 8, an alternate embodiment of a truss 47 according to the present invention has opposed end sections. However, only left end section 47*a* is shown. The relatively thin sheet 42 described hereinabove with reference to FIGS. 1–6 is replaced by a wooden connector block 48 having a length of approximately 18 inches and a thickness of approximately 1.5 inches. Connector block 48 is cut from regular dimensional lumber to fit between top and bottom chords 12 and 14. In the alternate embodiment, the extension portions of the top and bottom chords 12 and 14 are not equipped with grooves. Rather, four holes are drilled into each extension portion 12*a*, 14*a*. Four holes are also drilled through the top and bottom surfaces of connector block 48. The first holes drilled through extension portions 12*a* and 14*a* are preferably approximately 1.5 inches from the respective ends of extension portions 12*a* and 14*a*. The remaining three holes are drilled at approximately 5 inch intervals.

Connector block 48 is positioned so that the four holes drilled in its top are in alignment with the respective four holes drilled in extension portion 12*a*. A dowel pin 50 is inserted through each aligned pair of holes. Similarly, the four holes drilled in the bottom of connector block 48 are aligned with the respective four holes drilled in extension portion 14*a*. A dowel pin 52 is inserted through each aligned pair of holes. Dowel pins 50 and 52 secure connector block 48 to top and bottom chords 12 and 14. Glue or another suitable fastener is preferably applied to dowel pins 50 and 52 and/or in the holes to secure dowel pins 50 and 52 within the respective aligned pairs of holes. Glue or another suitable fastener is also preferably applied between the top surface of connector block 48 and top chord 12 and between the bottom surface of connector block 48 and bottom chord 14 to further secure connector block 48 to both the top and bottom chords 12 and 14. Although not shown, the right end section of truss 47 is configured the same as left end section 47*a*.

In the alternate embodiment, each end section has a length of approximately 18 inches. The metal web 16 adjacent each end section overlaps the corresponding end section by approximately six inches so that the length of truss 47 may be adjusted within a two foot range (i.e., one foot on each end). For example, if the overall length of truss 47, including the end sections, is 20 feet, truss 47 may be adjusted for any length between 18 and 20 feet by selectively trimming one or both end sections 47*a*.

Various embodiments of the invention have now been described in detail. Since changes in and additions to the above-described embodiments may be made without departing from the nature, spirit or scope of the invention, the invention is not to be limited to said details, but only by the appended claims and their equivalents.

We claim:

1. A truss adapted for load bearing, comprising:

first and second generally parallel wooden chord members;

a plurality of V-shaped metal webs interconnecting said first and second chord members, each web having an apex portion and two elongated diverging legs with enlarged end portions, each web further including a plurality of teeth projecting from the apex portion and the enlarged end portions thereof, whereby the corresponding web is connected to said first and second chord members, the interconnection of said webs with said first and second chord members defining a primary section of said truss;

said first and second chord members having respective first and second extension portions extending in the same direction beyond said webs, said truss further including a wooden connector member and non-metallic attachment means for attaching said connector member to said first and second chord members along substantially the entire length of said first and second extension portions, but not along said primary section) to define an end section of said truss adjacent said primary section, said end section being adapted to be trimmed for lengthwise adjustment of said truss;

said first extension portion having a plurality of spaced apart first holes and said second extension portion having a plurality of spaced apart second holes, said connector member having a plurality of spaced apart third holes in alignment with respective first holes and a plurality of spaced apart fourth holes in alignment with respective second holes, said truss further including a plurality of first wooden pins extending through said first and third holes and attaching said connector member to said first extension portion and a plurality of second wooden pins extending through said second and fourth holes and attaching said connector member to said second extension portion.

2. The truss of claim 1 further including a wooden post member coupled between said first and second chord members and being intermediate said primary section and said end section, said webs terminating at said post member such that said webs do not extend beyond said primary section.

3. The truss of claim wherein 1 wherein one of said webs overlaps said end section, an end portion of said one of said webs being connected to one of said first and said second extension portions.

4. The truss of claim 1 wherein said connector member is a wooden block, said first holes being located on a first surface of said block and said second holes being located on a second surface of said block, said second surface being in opposing relationship with said first surface.

5. The truss of claim 1 further including adhesive means for securing said first pins in said first holes and said second pins in said second holes.

6. A truss adapted for load bearing, comprising:

first and second generally parallel wooden chord members;

a plurality of V-shaped metal webs interconnecting said first and second chord members, each web having an apex portion and two elongated diverging legs with enlarged end portions, each web further including a plurality of teeth projecting from the apex portion and the enlarged end portions thereof, whereby the corresponding web is connected to said first and second chord members, the interconnection of said webs with said first and second chord members defining a primary section of said truss;

said first and second chord members having respective first and second extension portions extending in the same direction beyond said webs and third and fourth extension portions extending beyond said webs in an opposite direction from said first and second extension portions, said truss further including a first wooden connector member and first non-metallic attachment means for attaching said first wooden connector member to said first and second chord members along substantially the entire length of said first and second extension portions, but not along said primary section, to define a first end section of said truss adjacent said primary section, said truss further including a second wooden connector member and second non-metallic attachment means for attaching said second wooden connector member to said first and second chord members along substantially the entire length of said third and fourth extension portions, but not along said primary section, to define a second end section of said truss adjacent said primary section, said primary section being intermediate said first and second end sections, each of said first and second end sections being adapted to be trimmed for lengthwise adjustment of said truss;

said first, second, third and fourth extension portions each having a plurality of spaced apart holes, said first wooden connector member having a plurality of first holes in alignment with respective holes in said first extension portion and a plurality of second holes in alignment with respective holes in said second extension portion, said second wooden connector member having a plurality of third holes in alignment with respective holes in said third extension portion and a plurality of fourth holes in alignment with respective holes in said fourth extension portion, said first non-metallic attachment means including a plurality of first wooden pins extending through the holes in said first extension portion and said first holes for attaching said first wooden connector member to said first extension portion and a plurality of second wooden pins extending through the holes in said second extension portion and said second holes for attaching said first wooden connector member to said second extension portion, said second non-metallic attachment means including a plurality of third wooden pins extending through the holes in said third extension portion and said third holes for attaching said second wooden connector member to said third extension portion and a plurality of fourth wooden pins extending through the holes in said fourth extension portion and said fourth holes for attaching said second wooden connector member to said fourth extension portion.

7. The truss of claim 6 further including first and second wooden post members coupled between said first and second chord members, said first post member being intermediate said primary section and said first end section, said second post member being intermediate said primary section and said second end section, said webs being arranged along said primary section such that said webs do not extend beyond either of said first and second post members.

8. The truss of claim 6 wherein a first one of said webs overlaps said first end section and a second one of said webs overlaps said second end section, an end portion of said first web being connected to one of said first and said second extension portions and an end portion of said second web being connected to one of said third and fourth extension portions.

* * * * *